United States Patent [19]

Clement

[11] Patent Number: 4,958,413

[45] Date of Patent: Sep. 25, 1990

[54] DRIVE MECHANISM FOR A FEED ROLL OF A COMBING MACHINE

[75] Inventor: Heinz Clement, Winterthur, Switzerland

[73] Assignee: Rieter Machine Works, Ltd., Winterthur, Switzerland

[21] Appl. No.: 285,215

[22] Filed: Dec. 16, 1988

[30] Foreign Application Priority Data

Dec. 24, 1987 [CH] Switzerland ..... 5059/87

[51] Int. Cl.[5] ..... D01G 19/18

[52] U.S. Cl. ..... 19/115 R; 19/225; 19/223; 19/232; 19/233; 19/234; 19/235

[58] Field of Search ..... 19/223, 225, 232, 234, 19/235, 115 R, 105; 192/45

[56] References Cited

U.S. PATENT DOCUMENTS

| | | | |
|---|---|---|---|
| 289,110 | 11/1883 | Kempster | 192/45 X |
| 512,538 | 1/1894 | Clark | 192/45 X |
| 1,446,750 | 2/1923 | Jolly | 19/233 X |
| 2,558,706 | 6/1951 | Hinson | 19/223 |
| 3,004,300 | 10/1961 | Naegli | 19/235 |
| 3,400,431 | 9/1968 | Strzelewicz | 19/225 |
| 3,604,063 | 9/1971 | Von Kaenel et al. | 19/231 |
| 4,566,567 | 1/1986 | Miyatake | 192/45 |

FOREIGN PATENT DOCUMENTS

| | | |
|---|---|---|
| 1139414 | 11/1962 | Fed. Rep. of Germany . |
| 3336812 | 6/1984 | Fed. Rep. of Germany . |
| 0224822 | 11/1985 | Japan . |
| 0092086 | 12/1921 | Switzerland . |

*Primary Examiner*—Werner H. Schroeder
*Assistant Examiner*—Ismael Izaguirre
*Attorney, Agent, or Firm*—Kenyon & Kenyon

[57] ABSTRACT

The drive mechanism for the feed roll of a combing machine employs a freewheel having an inner member secured to the feed roll and a concentric outer member secured to the pivotal arm which mounts the top nipper. In addition, locking elements are disposed between the inner and outer members and the outer member provided with a sawtooth configuration so that the locking elements may lock during rotation of the outer member under the influence of the arm and may move into a released position during an opposite rotation of the outer member. The lost motion or idle travel in the changeover between the released position and the locking position is quite reduced. Thus, feeds are always of substantially exactly the same magnitude with a resulting improvement in the produced sliver.

7 Claims, 5 Drawing Sheets

DRIVE MECHANISM FOR A FEED ROLL OF A COMBING MACHINE

This invention relates to a drive mechanism for a feed roll of a combing machine.

As is known, combing machines have frequently been constructed with supports which can be reciprocated back and forth and on which a top nipper can be mounted by means of a pivot arm in order to be raised and lowered in cadence with the motion of the support. It is also known in the spinning art to use the movement of the top nipper of a combing machine to drive a feed roll both in feed during a forward stroke, that is to drive the feed roll in response to a forwards movement of the nipper, and in feed during a backwards stroke, that is, the feed roll is driven in response to a backwards movement of the nipper.

In the past, it has been known to use stepping wheels to drive the feed roll. However, one disadvantage of such a device is that the stepping wheels must be exchanged at changeovers between the two kinds of feed. Further, the exchanging of stepping wheels has been a relatively complicated matter which always necessitates the demounting and assembling of a whole unit of the combing machine.

DDR-patent 218782 A3 discloses a feed roll drive with a simpler form of changeover between feed during forwards stroke and feed during backwards stroke. In this respect, the feed roller is described as being moved by means of pawl-actuated gears and the changeover between the two kinds of feed is effected by shifting the pawls alternately into their operative position and inoperative position. However, this arrangement has the disadvantage of an increased noise level because cf the cooperation between the pawls and ratchet wheels.

U.S. Pat. No. 3,604,063 describes a textile fiber comber having an oscillating nipper shaft for oscillating a nipper mechanism which is arranged to drive a feed roll by means of ratchet wheels and a pawl. However, aside from the noise level, the stop position of such a pawl relative to the teeth of the ratchet wheel and, therefore, the magnitude of the feeds, may only vary over a distance equal to the spacing between adjacent teeth. Furthermore, this spacing, which represents the minimum feed, cannot be reduced below a certain level.

German A.S. 1,139,414, German 0.S. 3,336,812 and Swiss Patent 92,086 also describe ratchet and pawl arrangements for driving a feed roll of a comber.

Accordingly, it is an object of the invention to insure that the feeds of a feed roll of a combing machine are substantially always of the same magnitude.

It is another object of the invention to improve the quality of the sliver produced on a combing machine.

It is another object of the invention to enable the minimum feed of a combing machine to be reduced as required.

Briefly, the invention provides a drive mechanism for a feed roll of a combing machine which includes at least one pivotally mounted arm which is movable between a raised position and a lowered position and which is adapted to carry a top nipper thereon. In addition, the mechanism includes a freewheel having an inner member adapted to be secured to a feed roll for rotation thereof, an outer member concentric to and rotatable about the inner member and a plurality of locking elements between the two members which are moveable in response to rotation of the outer member in order to move between a release position allowing free rotation of the outer member relative to the inner member and a locking position locking the members together. In addition, the mechanism employs a means which connects the outer member to the pivotally mounted arm for rotation of the outer member in response to movement of the arm between the raised and lowered positions to effect a feed roll stroke.

The means connecting the outer member of the freewheel to the pivotal arm may include a lug secured to the outer member and a link which is pivotally connected between and to the lug and the arm. This link may also be connected to the arm in one of a plurality of positions in order to vary the magnitude of the feed roll stroke.

In another embodiment, the means connecting the outer member of the freewheel to the pivotal arm may include a gear segment secured to the outer member and a second gear segment secured to the arm for pivoting therewith in meshing relation with the gear segment on the outer member of the freewheel.

In still another embodiment, the means connecting the outer member to the arm may include a pair of lugs secured on opposite sides of the outer member with links connected to and between each lug and the pivotal arm in a selective manner. That is, only one link at a time would be operatively connected.

The freewheel which is used in the various embodiments produces feeds which are always of the same magnitude. That is, the lost motion, i.e. clearance, arising at changeover from a release position to a locking position can be very small. Consequently, the feeds of the feed roll may always be of substantially the same magnitude.

These and other objects and advantages of the invention will become more apparent from the following detailed description taken in conjunction with the accompanying drawings wherein.

Figure 1:
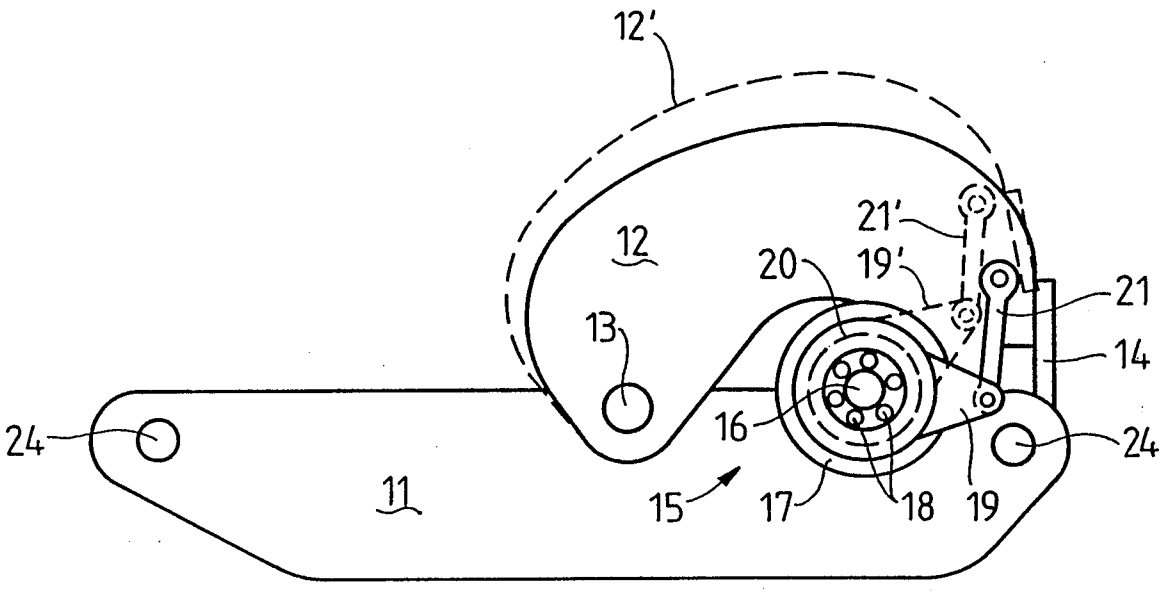
FIG. 1 illustrates a diagrammatic view in side elevation of a drive mechanism constructed in accordance with the invention.

Referring FIG. 1, the drive mechanism is constructed for use in a combing machine which is of otherwise known construction and need not be further described. As indicated, the drive mechanism is mounted on a support 11 which is able to move forwards, i.e. to the right as viewed, and backwards via suitable means (not shown). In addition, the support 11 supports a pivot shaft 13 which is perpendicular to the plane of FIG. 1 on which an arm 12 is pivotally mounted so as to move between a raised position 12 as indicated in dotted line and a lowered position. A top nipper 14 of a nipper of a combing machine is secured to the end of the arm 12.

In addition, a freewheel 15 is disposed between the arm 12 and a feed roll 20 of a combing machine. The freewheel 15 has an inner member 16 which is rigidly connected to the feed roll 20 for rotation of the feed roll, for example being disposed coaxially of the roll 20. As illustrated, the freewheel 15 masks the roll 20.

The freewheel 15 also has an outer member 17 concentric and rotatable about the inner member 16 as well as a plurality of locking elements 18 between the members.

Figure 2:
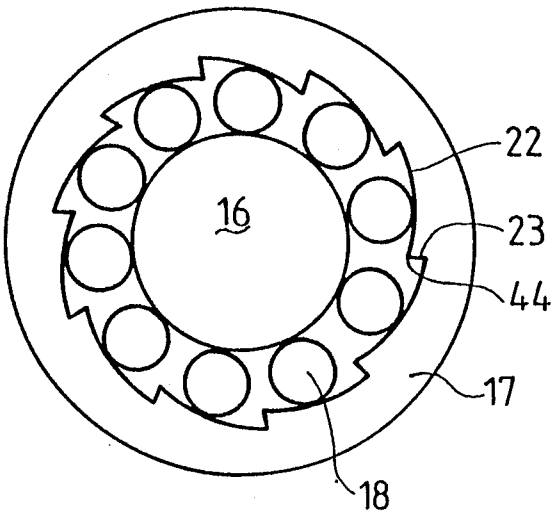
FIG. 2 illustrates a side view of a freewheel used in the mechanism of FIG. 1.

As indicated in FIG. 2, the inner member 16 of the freewheel 15 is of cylindrical shape as is the outer member 17. However, the inner generated surface of the outer member 17 is of sawtooth cross-section with rising parts 22 and falling parts 23 which define edges 44 therebetween. The locking members 18 which are in the form of cylinders or balls have some clearance when disposed very near the edges 44. The locking elements 18 are movable in response to rotation of the outer member 17 in order to move between one of a release position allowing free rotation of the outer member 17 relative to the inner member 16 and a locking position, as shown, near the edges 44 locking the members 16, 17 together.

Referring to FIG. 1, a means is provided for connecting the outer member 17 to the pivotal arm 12 for rotation of the outer member 17 in response to movement of the arm 12 between the raised and lowered positions thereof. As indicated, this means includes a lug 19 which is secured to and which extends from the outer member 17 as well as a link 21 which is pivotally connected between and to the lug 19 and the arm 12. This link 21 is secured after the fashion of a crank to the lug 19 and the arm 12.

As indicated, the support 11 is mounted on a pair of retaining rods 24 which extend perpendicular to the support 11 and are operative to reciprocate the support 11 and, therefore, to pivot the top nipper 14 as is known.

Figure 3:
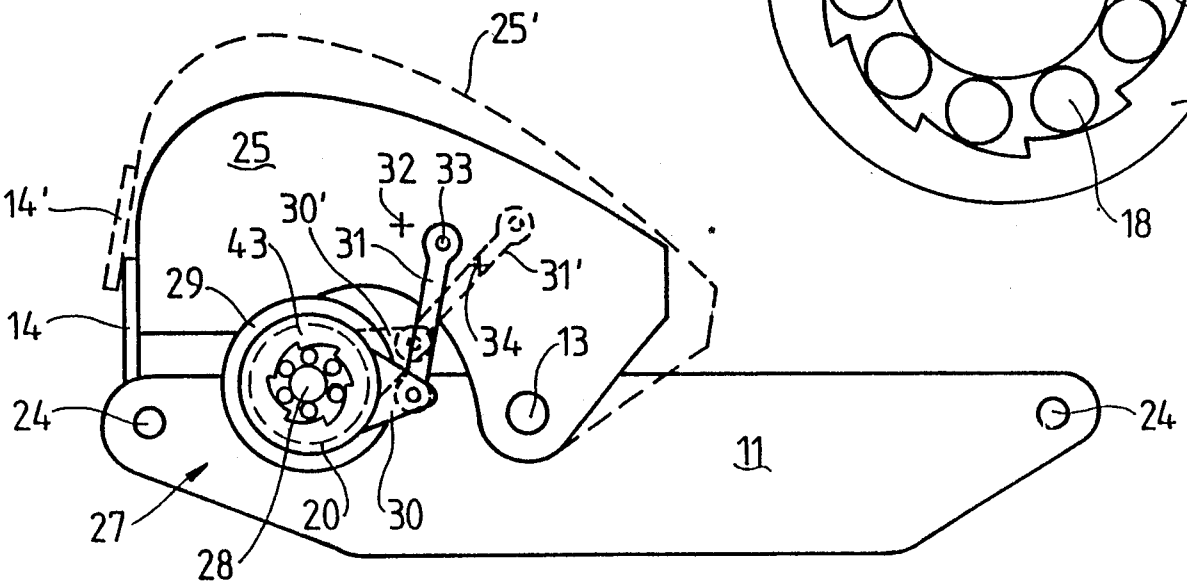
FIG. 3 illustrates a diagrammatic view in side elevation of the mechanism of FIG. 1 as viewed from an opposite side.

Referring to FIG. 3, which is a side elevation of the opposite side wall of the support 11, it is to be noted that the side walls of the support 11 are disposed at opposite ends of the feed roll 20. In addition, the right-hand side and left-hand side have been laterally inverted as between FIGS. 3 and 1 with the front of the drive mechanism being on the right in FIG. 1 and on the left in FIG. 3.

As indicated in FIG. 3, wherein like reference characters indicate like parts as above, the end of the top nipper 14 is secured to a second arm 25 which is pivotable about the pivot shaft 13. In addition, a second freewheel 27 similar to that as shown in FIG. 2 is disposed between the arm 25 and the feed roll 20. This freewheel 27 has an inner member 28 secured to the feed roll 20, an outer member 29 about the inner member 28 and locking members 43 between the members 28, 29. In addition, a lug 30 is secured to the outer member 29 while a link 31 is pivotally connected between the lug 30 and the arm 25.

For the description of the operation, it will be assumed that the drive mechanism for the feed roll 20—i.e., the support 11 and the parts carried thereby and shown in FIGS. 1 and 3—is in its rear position in which the nipper remains closed. When the drive mechanism is in its front position, the nipper remains open. The latter state is shown in chain lines in FIGS. 1 and 3 and has the references 12', 25' for the arms, 14' for the top nipper, 19', 30' for the lugs and 21', 31' for the links.

The nipper opens in response to the forwards movement of the drive mechanism—i.e., of the support 11—because of the arm 12 pivoting upwards around the pivot shaft 13 into position 12'. During this pivoting motion of the arm 12, the link 21 is entrained, as can be seen in FIG. 1, and moved into the chain-line position 21'. The lug 19 is therefore also rotated into its chain-line position 19' and the freewheel outer member 17 which is rigidly secured to the lug 19 corotates—i.e., rotates anticlockwise. As can be gathered from FIG. 2, this results in the locking members 18 locking so that the freewheel inner member 16 and, therefore, the feed roll 20 rigidly connected to the member 16 are driven. Consequently, the feed roll 20 feeds the fiber feed (not shown) in the forwards direction—i.e., to the right in FIG. 1.

When the support 11—i.e., the drive mechanism—then moves back, the nipper closes, the arm 12 pivoting down around the pivot shaft 13. In this step, the link 21 pushes the lug 19 into its initial position. The outer member 17 therefore rotates clockwise so that the locking members 18 are moved on to the falling parts 23 shown in FIG. 2, where they have more space—i.e., some clearance—and are therefore not locked. No turning force is therefore applied to the inner member 16 so that the member 16 and, therefore, the feed roll 20 remain unaffected by the descent of the arm 12—i.e., during the closing of the nipper.

After the supports have returned to their rear position and the nipper has reclosed, combing proceeds, whereafter the operation hereinbefore described repeats. Clearly, a stepwise feeding movement occurs with each forwards movement of the support 11, and so feed during forwards stroke is operative.

Referring to FIG. 3, the freewheel 27, which also has locking members 43, must be operative and inoperative the opposite way round as compared with FIG. 2. This is indicated in FIG. 3 by the shape of the inside surface of the outer member 29. In the forwards movement of the supports 11, such movement being a movement to the left in FIG. 3, the arm 25 pivoting into its position 25' and the top nipper 14 pivoting into its open position 14', the link 31 moves into the chainline position 31'. The lug 30 is then entrained and in its entrainment rotates the freewheel outer member 29 against the direction of entrainment thereof—i.e., inoperatively. The feed roll 20 therefore does not move.

In the subsequent return movement of the support 11, the arm 25 pivots back around the pivot 13 from its position 25' into its initial position and the top nipper 14 returns to its closed position, the link 31 and the lug 30 also returning from their respective positions 31', 30' to their respective initial positions. The outer member 29 is rotated in the entrainment direction of the freewheel 27—i.e., clockwise as viewed in FIG. 3—and the entrained inner member 28 rotates the fed roll 20 clockwise so that the fiber feed is moved forwards—i.e., to the left in FIG. 3. Upon completion of the return movement of the top nipper 14, the machine nipper clamps the fibers, whereafter the combing movement proceeds. Consequently, in the operation in accordance with FIG. 3, a feeding movement occurs stepwise at each backwards movement of the drive mechanism, corresponding to a feed during backwards stroke.

When the link 21 in the mechanism of FIGS. 1 and 3 is operative and the link 31 is inoperative, the mechanism operates on feed during a forwards stroke. In the reverse case, the mechanism operates on feed during a backwards stroke. When the two links 21, 31 are used simultaneously, two movements of the feed roll 20 and, therefore, two advances of the fiber feed occur between two consecutive closing movements of the machine nipper—i.e., between two consecutive comb movements. The quantity of fiber material advanced per comb movement can be varied in this way.

Another example of the procedure for providing such a variation of the quantity of fiber material fed per combing operation will be described with reference to FIG. 3. In this example, the arm 25 has three different fixing or securing positions 32–34 to which that end of the link 31 which is the top end in FIG. 3 can be secured. The positions 32–34 are disposed at different distances from the pivot 13, consequently their travels associated with the pivoting movements of the arm 25 differ from one another and therefore produce different feed steps.

The strokes can also be varied by varying the angular positioning of the lug 30 and the radial distance between the securing of the link 31 to the lug 30 and the rotational axis of the freewheel.

Figure 4:
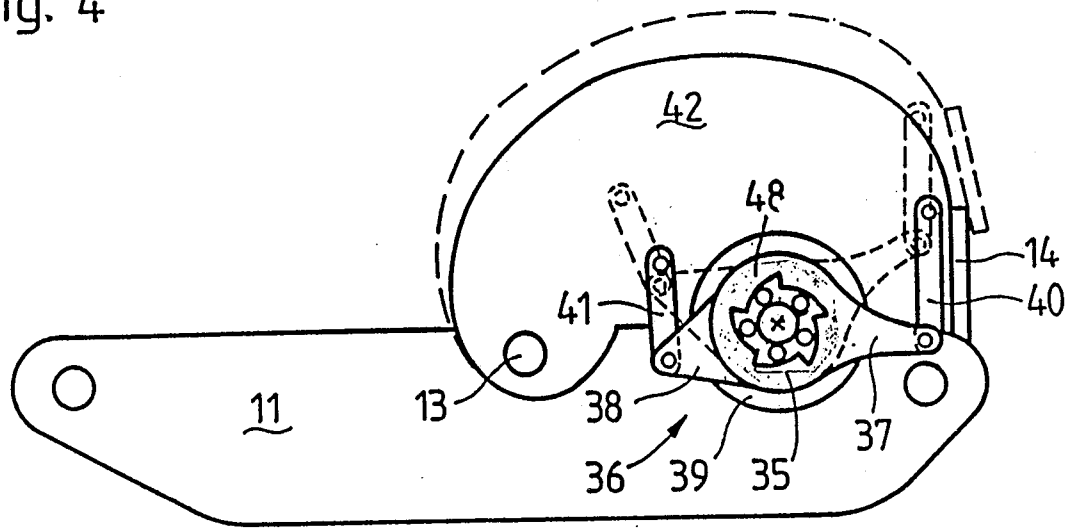
FIG. 4 illustrates a view similar to FIG. 1 of a modified drive mechanism in accordance with the invention.

In the example described in the foregoing, a freewheel 15, 27 is present at each end of the feed roll 20. However, just a single freewheel can be provided and a corresponding embodiment is shown in FIG. 4 wherein a feed roll (not shown) is rigidly connected to an inner member 35 of a freewheel 36. Two lugs 37, 38 which are disposed opposite one another as referred to the rotational axis of the freewheel 36 are rigidly connected to an outer member 39. Lug 37 is coupled by way of a link 40 to an arm 42 and lug 38 is coupled thereto by way of a link 41. The arm 42 together with a second arm (not shown) carries a top nipper 14 and is pivotable around a pivot shaft 13. The pivoted positions are as previously shown in chain lines. The forwards movement of the drive mechanism—i.e., of the support 11—is to the right To describe the operation, it will be assumed that the freewheel 36 is of the kind shown in FIG. 2 and that one of the links 40, 41 is connected and the other disconnected alternately or rendered inoperative in some other fashion Clearly, therefore, when the top nipper 14 rises—i.e., when the support 11 moves to the right—a pull on the link 40 does not rotate the feed roll and in the subsequent descent of the top nipper 14—i.e., of the arm 42—the freewheel 36 rotates the feed roll clockwise as viewed. Consequently, with the link 40 operative there is feed during backwards stroke. When the link 40 is inoperative and the link 41 operative, the freewheel 36 turns idly during the descent of the top nipper 14 and during the ascent thereof, the link 41 acts by way of the lug 38 to rotate the outer member 39 and, therefore, the feed roll clockwise. In this case, therefore, there is feed during forwards stroke.

Clearly, for changing over between the two kinds of feed, the links 21, 31 of FIGS. 1 and 3 and the links 40, 41 of FIG. 4 must be alternately operative and inoperative.

Another possibility, for example, for an arrangement of the kind shown in FIGS. 1 and 3, is for the lugs 19, 30 to be secured to the inner members 16, 28 and for the feed roll 20 to be secured to the outer members 17, 29.

In the case of the freewheel shown in FIG. 2, the space available for the locking members 18 in the inoperative state—i.e., the clearance for the locking members 18—is in practice less than that shown in FIG. 2. Space conditions are such that only when the locking members 18 are in the position in which they are immediately adjacent the edge 44 is there a reduced clearance around them. Consequently, the idle or lost motion referred to in the introduction hereof and occurring at a changeover between the inoperative release position and the operative locking position is very reduced.

Figure 5:
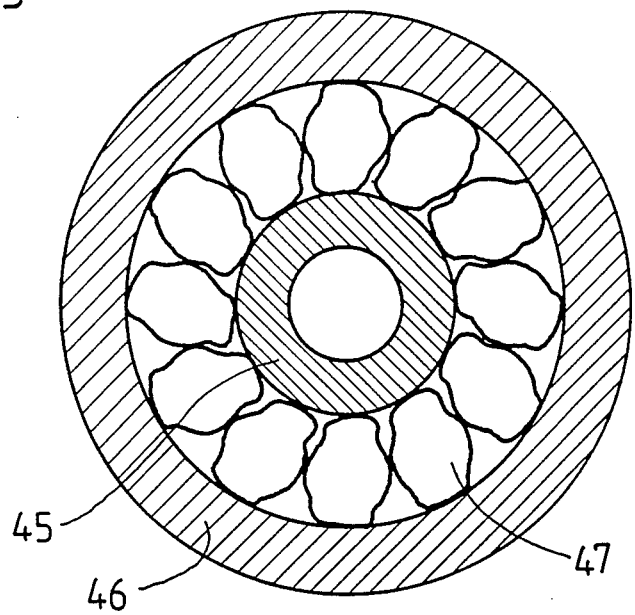
FIG. 5 illustrates a side view of a modified freewheel constructed in accordance with the invention.

FIG. 5 shows another and commercially available freewheel which because of the reduced amount of feed is advantageous and of reduced cost. The freewheel comprises an inner member 45, an outer member 46 and locking members 47 of rectangular-like cross-section disposed therebetween. When the outer member 46 rotates anticlockwise, the locking members 47 are pressed into their upright position and are thus locked with the members 45, 46.

Figure 6:
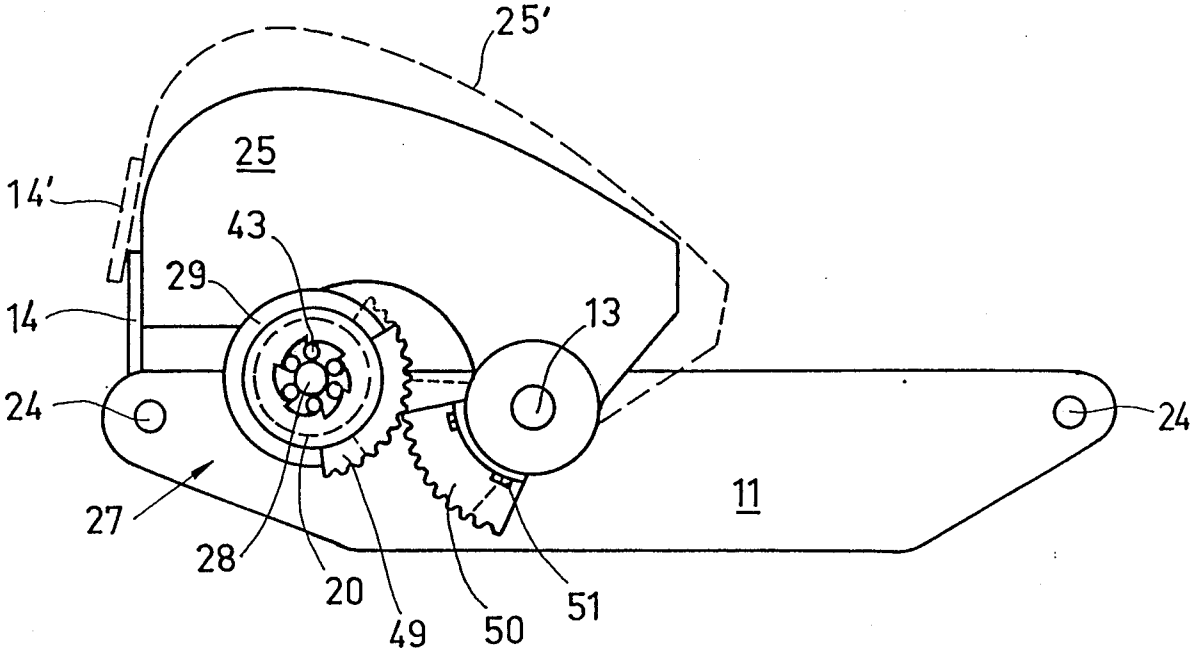
FIG. 6 illustrates a view similar to FIG. 3 of a modified drive mechanism employing gear segments in accordance with the invention.

Referring to FIG. 6, wherein like reference characters indicate like parts as above, the drive mechanism includes a freewheel as above and a means including a pair of meshing gear segments 49, 50 both connecting the outer freewheel member 29 to the pivotal arm 25. As indicated, one gear segment 49 is secured to and extends from the outer member 29 in a concentric manner. The other gear segment 50 is secured as by bolts 51 to the arm 25 so as to pivot therewith about the pivot shaft 13. Thus, during movement of the arm 25 into the raised position 25', the meshing gear segments 49, 50 cause the outer member 29 to rotate in a counterclockwise manner with the locking elements 43 being in a released position. During movement of the arm 25 into the lowered position, the gear segments 49, 50 cause a clockwise rotation of the outer member 29 and thus a locking of the locking elements 43. This causes the inner member 28 and attached feed roll 20 to rotate in a clockwise direction.

The invention thus provides a drive mechanism for the feed roll of a combing machine which is of relatively simple construction and which permits the feeds of the feed roll to be substantially the same magnitude during change over. In addition, the invention provides a drive mechanism which can be readily changedover so that a feeding movement occurs stepwise at each backwards movement of the drive mechanism or at each forwards movement of the drive mechanism.

Still further, the invention provides a drive mechanism which can be readily adjusted to vary the feed magnitude of a comber.

What is claimed is:

1. A drive mechanism for a feed roll of a combing machine, said mechanism comprising at least one pivotally mounted arm movable between a raised position and a lowered position and adapted to carry a top nipper thereon;

a freewheel having an inner member adapted to be secured to a feed roll for rotation thereof, an outer member concentric to and rotatable about said inner member and a plurality of locking elements between said members, said elements being movable in response to rotation of said outer member to move between one of a release position allowing free rotation of said outer member relative to said inner member and a locking position locking said members together; and means connecting said outer member to said arm for rotation of said outer member in response to movement of said arm between said positions thereof, said means including a lug secured to and extending from said outer member and a link pivotally connected between and to said lug and said arm.

2. A drive mechanism as set forth in claim 1 wherein said link is connected to said arm in one of a plurality of positions to vary the magnitude of feed roll stroke.

3. A drive mechanism for a feed roll of a combing machine, said mechanism comprising a pair of pivotally mounted arms movable about a common axis between a raised position and a lowered position and adapted to carry a top nipper thereon;

a first freewheel on one of said arms, said freewheel having an inner member for securement to a feed roll, an outer member concentric to and rotatable about said inner member and a plurality of locking elements between said members, said elements being movable in response to rotation of said outer member to move between one of a release position allowing free rotation of said outer member relative to said inner member and a locking position locking said members together;

a second freewheel on the other of said arms, said second freewheel having an inner member for securement to the feed roll, an outer member concentric to and rotatable about said latter inner member and a plurality of locking elements between said latter members, said latter elements being movable in response to rotation of said latter outer member to move between one of a release position allowing free rotation of said latter outer member relative to said latter inner member and a locking position locking said latter members together;

first means connecting said outer member of said first freewheel to said one arm for rotation of said outer member in a clockwise direction in response to movement of said one arm to said raised position thereof; and second means connecting said outer member of said second freewheel to said other arm for rotation of said outer member in a counterclockwise direction in response to movement of said other arm to said raised position thereof.

4. A drive mechanism as set for the in claim 3 wherein said locking elements of said first freewheel are movable into said locking position thereof in response to movement of said arms to said raised positions thereof and said locking elements of said second freewheel are movable into said release position thereof in response to movement of said arms to said raised positions.

5. A drive mechanism for a feed roll of a combing machine, said mechanism comprising at least one pivotally mounted arm movable between a raised position and a lowered position and adapted to carry a top nipper thereon;

a freewheel having an inner member adapted to be secured to a feed roll for rotation thereof, an outer member concentric to and rotatable about said inner member and a plurality of locking elements between said members, said elements being movable in response to rotation of said outer member to move between one of a release position allowing free rotation of said outer member relative to said inner member and a locking position locking said members together;

means connecting said outer member to said arm for rotation of said outer member in response to movement of said arm between said positions thereof;

said means including a first gear segment secured to and extending from said outer member and a second gear segment secured to said arm for pivoting therewith, said gear segments being disposed in meshing relation.

6. A drive mechanism for a feed roll of a combing machine, said mechanism comprising at least one pivotally mounted arm movable between a raised position and a lowered position a and adapted to carry a top nipper thereon;

a freewheel having an inner member adapted to be secured to a feed roll for rotation thereof, an outer member concentric to and rotatable about said inner member and a plurality of locking elements between said members, said elements being movable in response to rotation of said outer member to move between one of a release position allowing free rotation of said outer member relative to said inner member and a locking position locking said members together;

means connecting said outer member to said arm for rotation of said outer member in response to movement of said arm between said positions thereof;

said means including a pair of lugs secured on opposite sides of said outer member, a first link selectively connected to and between said arm and one of said lugs and a second link selectively connected to and between said arm and the other of said lugs.

7. A process of feeding fiber through a nipper of, a combing machine comprising the steps of moving a nipper in a forward stroke while raising a top nipper to open the nipper;

rotating a feed roller in synchronism with raising of the top nipper to feed a preselecting length of fiber forwardly in proportion of said forward stroke;

thereafter moving the nipper in a rearward stroke while lowering the top nipper to close the nipper; and rotating the feed roller in synchronism with lowering of the top nipper to feed a preselected length of fiber forwardly in proportion to said rearward stroke.

* * * * *

UNITED STATES PATENT AND TRADEMARK OFFICE

CERTIFICATE OF CORRECTION

PATENT NO. : 4,958,413

DATED : Sept. 25, 1990

INVENTOR(S) : HEINZ CLEMENT

It is certified that error appears in the above-identified patent and that said Letters Patent is hereby corrected as shown below:

Column 5, line 34 change "right" to -right.-
Column 5, line 39 change "fashion Clearly" to -fashion. Clearly-
Column 7, line 38 change "for the" to -forth-
Column 8, line 39 change "of, a" to -of a-

Signed and Sealed this

Eighth Day of September, 1992

*Attest:*

DOUGLAS B. COMER

*Attesting Officer*

*Acting Commissioner of Patents and Trademarks*